US007014559B1

(12) United States Patent
Fong

(10) Patent No.: US 7,014,559 B1
(45) Date of Patent: Mar. 21, 2006

(54) GAMING MACHINE WITH SUBSTITUTE SYMBOLS

(75) Inventor: Colin Fong, Lane Cove (AU)

(73) Assignee: Aristocrat Technologies Australia Pty., Ltd., Lane Cove (AU)

( * ) Notice: Subject to any disclaimer, the term of this patent is extended or adjusted under 35 U.S.C. 154(b) by 0 days.

(21) Appl. No.: 10/111,024

(22) PCT Filed: Oct. 11, 2000

(86) PCT No.: PCT/AU00/01233

§ 371 (c)(1),
(2), (4) Date: Nov. 26, 2002

(87) PCT Pub. No.: WO01/28647

PCT Pub. Date: Apr. 26, 2001

(30) Foreign Application Priority Data

Oct. 18, 1999 (AU) ..... PQ3520

(51) Int. Cl.
*A63F 9/24* (2006.01)

(52) U.S. Cl. ..... 463/20; 463/16

(58) Field of Classification Search ..... 463/16, 463/20; 273/143 R

See application file for complete search history.

(56) References Cited

U.S. PATENT DOCUMENTS

| | | | |
|---|---|---|---|
| 1,681,683 | A | 8/1928 | Ramer |
| 3,580,581 | A | 5/1971 | Raven |
| 4,306,768 | A | 12/1981 | Egging |
| 4,448,419 | A | 5/1984 | Telnaes |
| 4,686,521 | A | 8/1987 | Beaven et al. |
| 4,711,451 | A | 12/1987 | Pajak et al. |
| 4,718,672 | A | 1/1988 | Okada |
| 4,743,024 | A | 5/1988 | Helm et al. |

(Continued)

FOREIGN PATENT DOCUMENTS

| | | |
|---|---|---|
| AU | 1988/17509 | 12/1988 |

(Continued)

OTHER PUBLICATIONS

Lara Croft Tomb Raider Web Page, http://shopping.yahoo-.com/shop?d=zvgm&id=1951008664&clink=dmks/Tomb_ Raider, p. 1.

(Continued)

*Primary Examiner*—Julie Brocketti
(74) *Attorney, Agent, or Firm*—Knobbe, Martens, Olson & Bear LLP

(57) ABSTRACT

A gaming machine includes a display on which a plurality of display of display positions are displayed. A game controller is arranged to control images displayed on the display. The controller also controls playing of a game on the machine wherein a plurality of symbols are randomly selected and displayed on the display such that if a winning combination results, the machine pays a prize. The controller is operable, upon the occurrence of a predetermined triggering event, to generate a bonus symbol which is displayed in a first display position and, thereafter in at least one other display position. In predetermined circumstances, when the bonus symbol moves from a preceding display position, a residual symbol remains at the preceding display position and, when the bonus symbol appears at a subsequent display position, both the original bonus symbol and the residual bonus symbol operates as substitute symbols in their display positions.

8 Claims, 6 Drawing Sheets

U.S. PATENT DOCUMENTS 4,756,531 A 7/1988 DiRe et al.
4,826,169 A 5/1989 Bessho et al.
4,838,552 A 6/1989 Hagiwara
4,856,787 A 8/1989 Itkis
4,871,171 A 10/1989 Rivero
5,042,818 A 8/1991 Weingardt
5,088,737 A 2/1992 Frank et al.
5,150,907 A 9/1992 Desmaraies et al.
5,228,693 A 7/1993 Howard
5,283,560 A 2/1994 Bartlett
5,344,145 A 9/1994 Chadwick et al.
5,351,966 A 10/1994 Tohyama et al.
5,354,069 A 10/1994 Guttman et al.
5,375,830 A 12/1994 Takemoto et al.
5,380,007 A 1/1995 Travis et al.
5,395,111 A 3/1995 Inoue
5,462,277 A 10/1995 Takemoto
5,580,053 A 12/1996 Crouch
5,596,693 A 1/1997 Needle et al.
5,630,753 A 5/1997 Fuchs
5,664,999 A 9/1997 Kurihara
5,673,401 A 9/1997 Volk et al.
5,704,835 A 1/1998 Dietz, II
5,732,950 A 3/1998 Moody
5,752,881 A 5/1998 Inoue
5,803,809 A 9/1998 Yoseloff
5,807,172 A 9/1998 Piechowiak
5,807,178 A 9/1998 Todokoro
5,816,915 A 10/1998 Kadlic
5,816,916 A 10/1998 Moody
5,823,873 A 10/1998 Moody
5,836,586 A 11/1998 Marks et al.
5,848,932 A 12/1998 Adams
5,853,325 A 12/1998 Kadlic
5,867,166 A 2/1999 Myhrvold et al.
5,868,619 A 2/1999 Wood et al.
5,880,709 A 3/1999 Itai et al.
5,890,962 A 4/1999 Takemoto
5,902,184 A 5/1999 Bennett
5,935,002 A 8/1999 Falciglia
5,951,397 A 9/1999 Dickinson
5,971,849 A 10/1999 Falciglia
5,980,384 A 11/1999 Barrie
6,004,208 A 12/1999 Takemoto et al.
6,007,066 A 12/1999 Moody
6,050,568 A 4/2000 Hachquet
6,059,289 A 5/2000 Vancura
6,062,978 A 5/2000 Marino et al.
6,089,977 A 7/2000 Bennett
6,089,978 A 7/2000 Adams
6,098,985 A 8/2000 Moody
6,106,393 A 8/2000 Sunaga et al.
6,113,102 A 9/2000 Marks et al.
6,118,427 A 9/2000 Buxton et al.
6,120,031 A * 9/2000 Adams ..... 273/292
6,120,378 A 9/2000 Moody
6,123,333 A 9/2000 McGinnis
6,126,542 A 10/2000 Fier
6,135,883 A 10/2000 Hachquet
6,135,884 A 10/2000 Hedrick et al.
6,149,156 A 11/2000 Feola
6,159,095 A 12/2000 Frohm et al.
6,159,097 A 12/2000 Gura
6,159,098 A 12/2000 Slomiany et al.
6,162,121 A 12/2000 Morro et al.
6,164,645 A 12/2000 Weiss
6,173,955 B1 1/2001 Perrie et al.
6,190,254 B1 2/2001 Bennett
6,203,429 B1 3/2001 Demar et al.
6,234,897 B1 5/2001 Frohm et al.
6,251,013 B1 6/2001 Bennett
6,254,481 B1 7/2001 Jaffe
6,261,177 B1 7/2001 Bennett
6,270,405 B1 8/2001 Ferguson
6,270,411 B1 8/2001 Gura et al.
6,290,600 B1 * 9/2001 Glasson ..... 463/20
6,312,334 B1 11/2001 Yoseloff
6,315,660 B1 11/2001 DeMar et al.
6,317,128 B1 11/2001 Harrison et al.
6,322,309 B1 11/2001 Thomas et al.
6,334,613 B1 1/2002 Yoseloff
6,346,043 B1 2/2002 Colin et al.
6,354,939 B1 3/2002 Morita et al.
6,368,216 B1 4/2002 Hedrick et al.
6,380,956 B1 4/2002 Yee et al.
6,443,837 B1 9/2002 Jaffe et al.
6,454,266 B1 9/2002 Breeding et al.
6,482,089 B1 11/2002 DeMar et al.
6,505,117 B1 1/2003 Ratert et al.
6,506,116 B1 1/2003 Sunaga et al.
6,508,707 B1 1/2003 DeMar et al.
6,520,855 B1 2/2003 DeMar et al.
6,529,626 B1 3/2003 Watanabe et al.
6,533,660 B1 3/2003 Seelig et al.
6,569,018 B1 5/2003 Jaffe
6,582,305 B1 6/2003 Carter
6,587,118 B1 7/2003 Yoneda

FOREIGN PATENT DOCUMENTS

AU 1994/70382 8/1995
AU 1997/45197 1/1998
AU 1999/43488 10/1999
AU 1999/42504 12/1999
AU 1999/43488 3/2000
AU 199943488 A1 3/2000
AU WO 00/32286 6/2000
DE 29 38 307 4/1981
DE 44 26 658 1/1996
EP 0 368 628 5/1990
GB 1535095 12/1978
GB 2056737 3/1981
GB 2072395 9/1981
GB 2 137 392 10/1984
GB 2229371 9/1990
GB 2233241 1/1991
GB 2252705 8/1992
GB 2271262 4/1994
WO WO 93/03464 2/1993
WO WO 96/08799 3/1996
WO WO 97/31344 8/1997
WO WO 97/32285 * 9/1997
WO WO 99/64997 12/1999

OTHER PUBLICATIONS

Fey, Marshall, Slot Machines A Pictorial History of the First 100 Years, 1983-1997, Liberty Belle Books, selected pages supplied by the Examiner as cited in U.S. Appl. No. 10/001,433.

* cited by examiner

GAMING MACHINE WITH SUBSTITUTE SYMBOLS

RELATED APPLICATIONS

This application claims the benefit of the Australian application PQ 3520 filed Oct. 18, 1999 and the international application PCT/AU00/01233 filed Oct. 11, 2000.

FIELD OF THE INVENTION

The present invention relates to a gaming machine. More particularly, the invention relates to a gaming machine of the type commonly known as a slot machine, a fruit machine or a poker machine.

BACKGROUND TO THE INVENTION

Players who regularly play gaming machines of the type in question quickly tire of particular games. It is therefore necessary for manufacturers of these machines to introduce innovative game features that add interest to the games provided on such machines in order to keep the players amused and interested and therefore willing to continue playing the games.

These machines have become well known locally and abroad over a number of years. More particularly, the machines have recently gained considerable popularity throughout Australia with substantial amounts of money being wagered on these machines. There is a growing tendency for state governments to legalise the use of gaming machines by licensing operators, with resulting revenue gains through licence fees and taxation of moneys invested. The licensed operation of gaming machines is the subject of state legislation and regulation. For example, a minimum of 85% of monies invested must be returned as winnings. Manufacturers of gaming machines therefore must design their machines around these regulatory controls.

With the growth that has occurred in the gaming machine market, there is intense competition between manufacturers to supply various existing and new venues. When selecting a supplier of gaming machines the operator of a venue will often pay close attention to the popularity of various games with their patrons. Therefore, gaming machine manufacturers are keen to devise games which are popular with players as a mechanism for improving sales.

Various strategies have been tried in the past to make games more enticing to players such as, for example, the commonly known double-up feature whereby, if a player wins a particular game, that player can then risk the winnings of the game in a double-or-nothing mode in which they gamble on a subsequent, and often different, game such as whether a red or black card will be the next card drawn.

Other techniques adopted in the past have been to provide complexity in the numbering and combinations of indicia which would result in a win, thereby hoping to convince the player that there is a greater chance of winning and to keep their interest in a particular game.

The present invention provides a game feature in which, in response to a trigger condition, a substitute or substitute symbol is introduced, the substitute symbol having additional features.

SUMMARY OF THE INVENTION

According to the invention, there is provided a gaming machine which includes:

a display means on which a plurality of display positions are displayed; and a game control means arranged to control images displayed on the display means, the control means also controlling playing of a game on the machine wherein a plurality of symbols are randomly selected and displayed on the display means such that, if a winning combination results, the machine pays a prize, the control means being operable, upon the occurrence of a predetermined triggering event, to generate a bonus symbol which is displayed in a first display position and, thereafter, in at least one other display position and, in predetermined circumstances, when the bonus symbol appears at one display position, a residual symbol remains and, when the bonus symbol appears at a subsequent display position, both the original bonus symbol and the residual symbol are taken into consideration in determining an award.

The present invention is applicable to video gaming machines of the traditional style in which the display means comprises a video simulation of a set of rotatable reels, each carrying a plurality of symbols. However, the invention is equally applicable to video draw poker machines in which a poker hand is displayed on the screen, the cards of the hand being selected from a standard 52 or 53 card deck, and other games such as keno, bingo, etc.

The bonus symbol may be any suitable bonus symbol such as a substitute/substitute symbol, a scatter symbol, a progressive symbol, second screen feature symbol, or the like. For ease of explanation, the invention will be described with reference to the special symbol being a substitute symbol. The substitute symbol may be triggered when a predetermined combination of symbols is "spun-up". Instead, the substitute symbol may be triggered when a special symbol is displayed in a particular position on the display means, either alone or in conjunction with one or more other, special symbols also at particular display positions. For example, the feature may be triggered by a predetermined first symbol appearing in the first (or left hand) column of the display and a second, different symbol appearing in the last (or right hand) column of the display. The predetermined first symbol and second symbol may each be a background symbol arranged behind another symbol.

The substitute symbol may be any suitable symbol.

For example, the substitute symbol may be an arrow which is "shot" at the display and, when it hits one of the symbols, it substitutes as a substitute in that position. If the original symbol then "ignites", the "flames" serve as the residual symbol. Instead, the arrow may be a "flaring arrow" which strikes one of the symbols. Animated flames may be displayed on the symbol where the arrow has pierced that symbol. The flames may substitute for all symbols except the scatter and any prizes in which the flames substitute will be paid. The flames may either continue to burn on that symbol for the duration of the feature or it may die out before the following arrow is fired. If the flames continue to burn, it continues to act as a substitute symbol throughout the feature whereas, if the flames die out before the next arrow is fired, it no longer acts as a substitute symbol.

In another embodiment, the substitute symbol may be in the form of a bird which migrates across the display to substitute for the conventional symbols of the reels. Where the bird lays an egg, the egg is the residual symbol.

In yet a further embodiment, the substitute symbol may be in the form of a penguin which migrates sequentially through each position on the display. In predetermined positions, a form of the penguin may be left behind which serves as the residual symbol.

BRIEF DESCRIPTION OF THE DRAWINGS

The invention is now described by way of example with reference to the accompanying drawings in which.

DETAILED DESCRIPTION OF THE DRAWINGS

Figure 1:
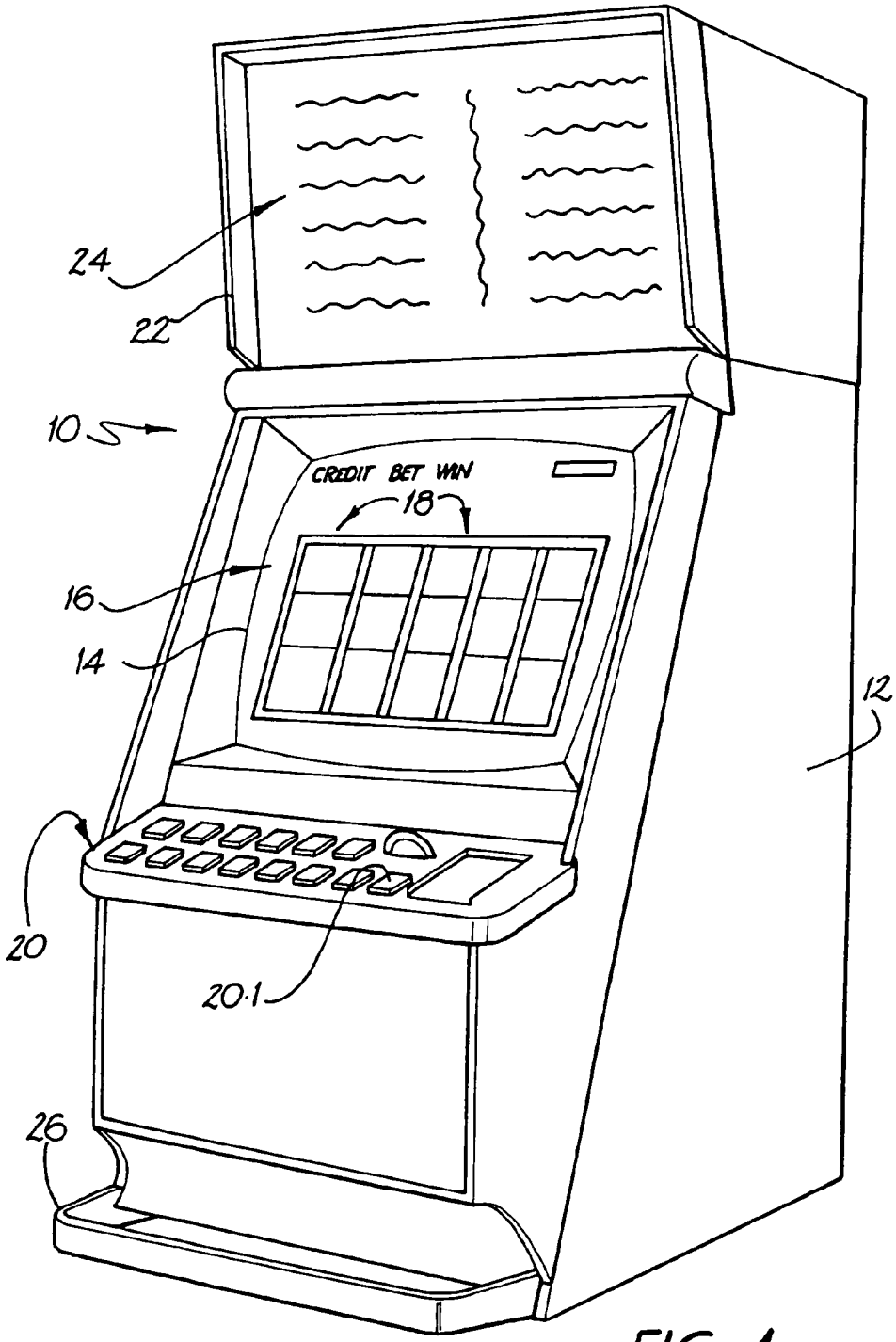
FIG. 1 shows a three dimensional view of a gaming machine, in accordance with the invention.

In FIG. 1, reference numeral 10 generally designates a gaming machine including a game, in accordance with the invention. The machine 10 includes a console 12 having a video display unit 14. The video display unit 14 includes a screen 16. Reels or reel strips 18 are simulated on the screen 16. A keypad 20 is provided on the console 12. The keypad 20 is operable to actuate "spinning" of the reel strips 18.

A top box 22 is mounted above the screen 16. The top box 22 displays one or more paytables 24.

A coin tray 26 is mounted beneath the console 12 for cash payouts from the machine 10.

Figure 2:
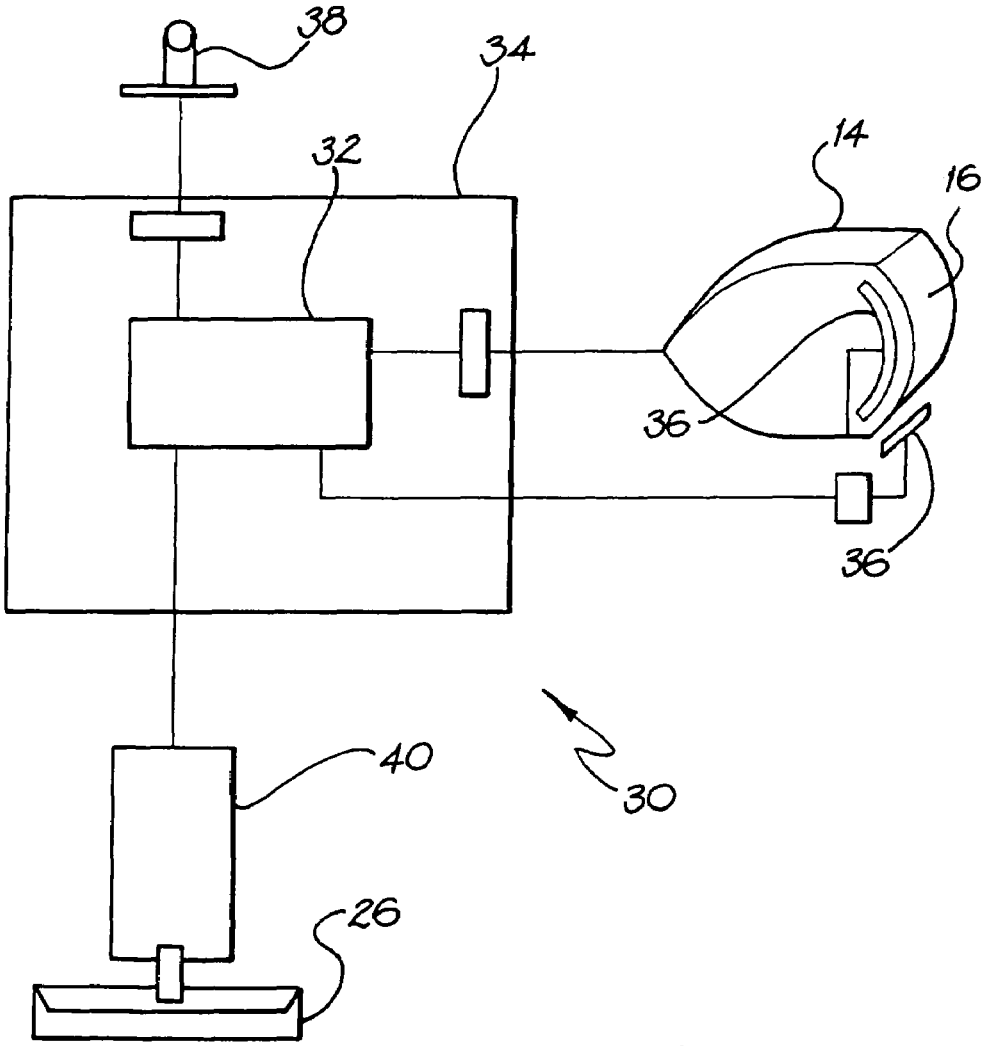
FIG. 2 shows a block diagram of a control circuit of the gaming machine.

As shown in FIG. 2 of the drawings, a control system 30 is illustrated. A program which implements the game and user interface is run on a processor 32 of the control system 30. The processor 32 forms part of a controller 34 which drives the screen 16 of the video display unit 14 and which receives input signals from sensors 36. The sensors 36 include sensors associated with the keypad 20. Instead, or in addition, the sensors 36 could include touch sensors mounted in the screen 16.

The controller 34 also receives input pulses from a mechanism 38 indicating that a player has provided sufficient credit to begin playing. The mechanism 38 may be a coin input chute, a bill collector, a credit card reader, or any other type of validation device. Finally, the controller 34 drives a payout mechanism 40 which, for example, may be a coin hopper for feeding coins to the coin tray 26 to pay a prize once a predetermined combination of symbols carried on the reels 18 appears on the screen 16.

Referring now to FIGS. 3 to 7 of the drawings, various screen displays of the screen 16 of a feature, are illustrated. In this description, it is assumed that any winning combination on a payline pays a prize as opposed to, for example, only a left-to-right combination. During the feature, the only prizes that are paid are for combinations in which the arrow and/or flames substitute. This applies also in respect of the embodiment described below with reference to FIGS. 8 to 12 of the drawings.

Figure 3:
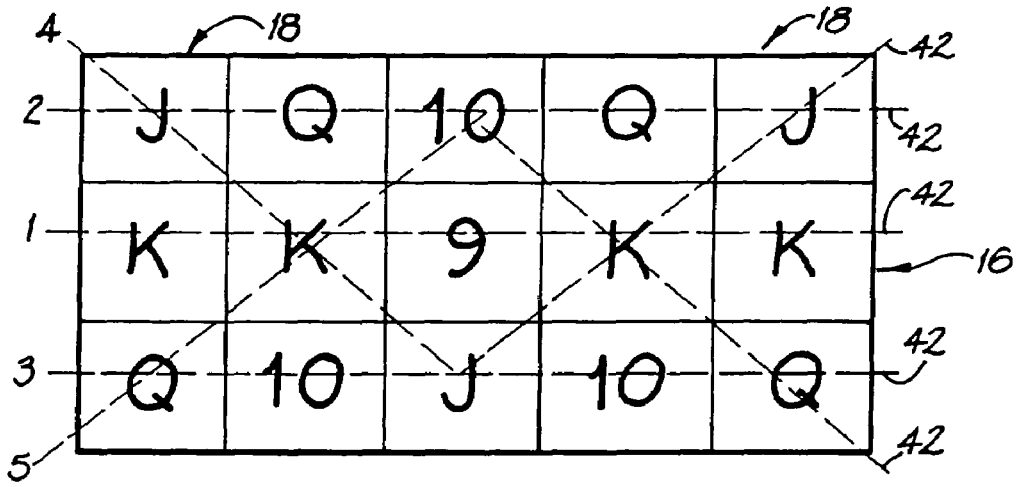
FIG. 3 shows a display screen of a game played on the gaming machine.
Figure 4:
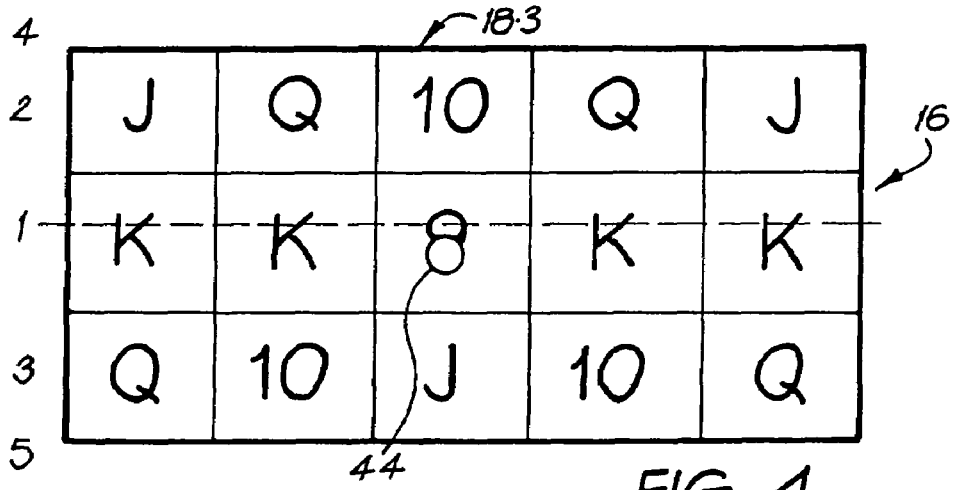
FIGS. 4 to 7 show various representations of display screens of an embodiment of a feature associated with the game of FIG. 3.

Once the button 20 is actuated, the reels 18 are spun up to form a display such as shown in FIG. 3 of the drawings. As illustrated, various paylines 42 are provided on which combinations of symbols pay a prize. Assuming that a predetermined trigger condition has been met, a substitute symbol is generated which, in the embodiment illustrated, is an arrow (not shown). Thus, as shown in FIG. 4, the arrow pierces the symbol "9" in reel 18.3 to leave a "hole" illustrated at 44. Thus, in this embodiment, the arrow as represented by the hole 44 acts as a substitute symbol so that a prize is paid for five of a kind (Kings).

Figure 5:
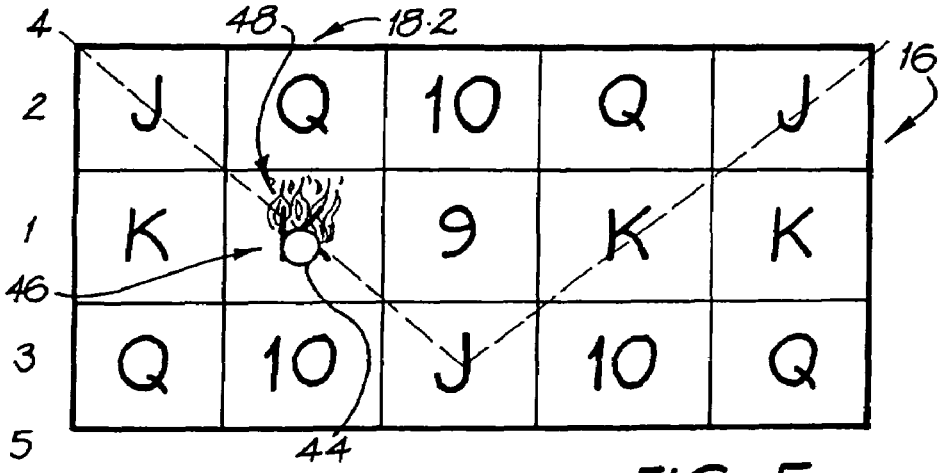

A second step of the feature is illustrated in FIG. 5 of the drawings, where the arrow hits the King symbol in reel 18.2. This symbol 46 ignites to leave a representation of flames 48 which represents a residual substitute symbol. Then, the arrow 44 is fired at the symbol "10" in reel 18.3 which, in turn, bursts into flames 48. Once again, the flames 48 remain behind and the arrow 44 strikes the Jack symbol in reel 18.1 as illustrated in FIG. 7 of the drawings which does not ignite.

As a result of the combination illustrated in FIG. 5 of the drawings and before the second arrow strikes the symbol "10" in reel 18.3, the flames act as a substitute symbol such that a payment is made for four Jacks on payline four and for four Kings on payline one. In addition, the flames act as a substitute symbol for a combination of three Queens on payline five.

Figure 6:
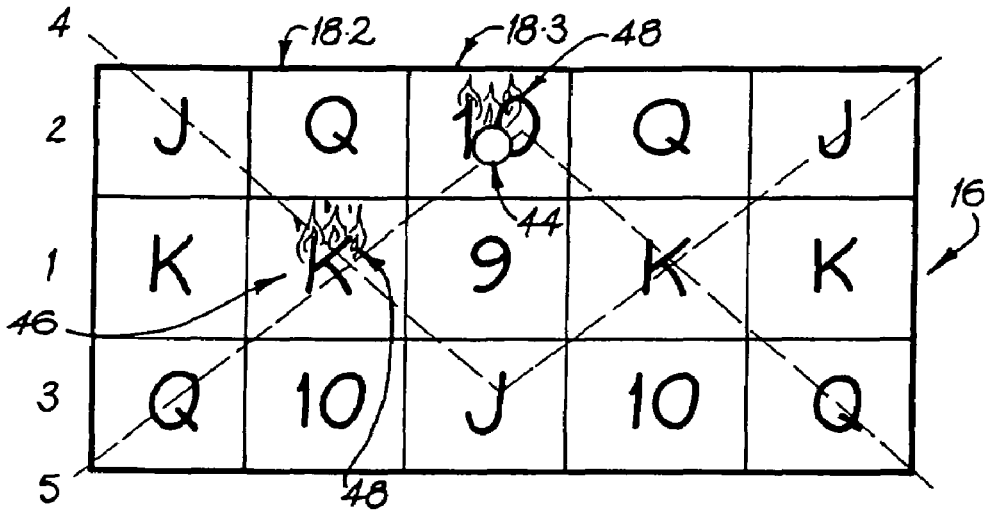

When the arrow strikes the symbol 10 in reel 18.3, various additional combinations are created. Thus, due to the residual flames 48 in reel 18.2 (as described above with reference to FIG. 5), and the new substitute symbol 44, (as illustrated in FIG. 6 of the drawings), various additional winning combinations are created, 4×King on payline one, 3×Queen and 3×Jack on payline two, 4×Jack on payline four and 4×Queen and 3×King on payline five.

Figure 7:
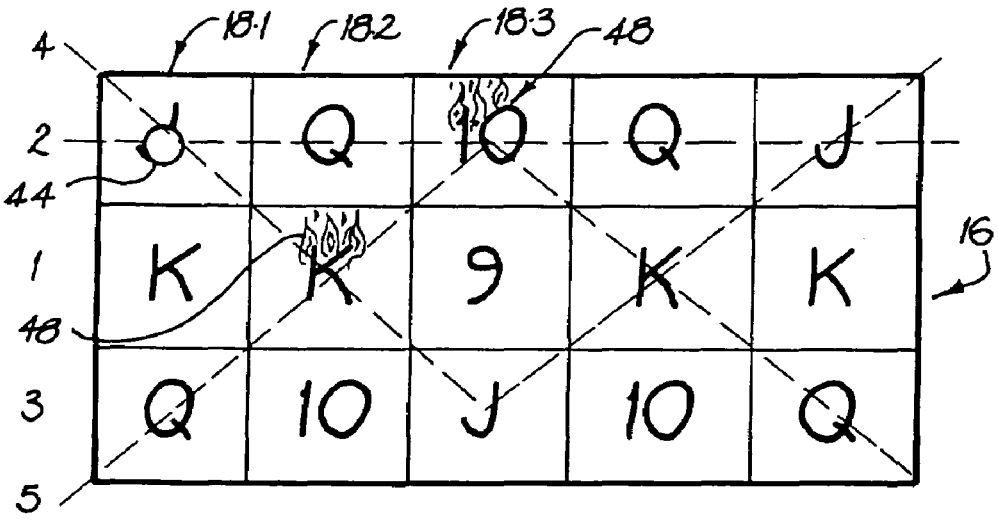

Finally, when the arrow strikes the Jack symbol in reel 18.1 as shown in FIG. 7 of the drawings, a prize is then paid for 4×Kings on payline one, 4×Queens on payline two, 3×Jacks on payline two, 4×Jacks and 3×Kings on payline four as well as 4×Queens and 3×Kings on payline 5.

Referring now to FIGS. 8 to 12, another embodiment of the invention described above with reference to FIGS. 3 to 7, is illustrated. With reference to FIGS. 3 to 7, like reference numerals refer to like parts, unless otherwise specified. However, this embodiment pays for prizes appearing in left to right and/or right to left combinations on a payline only as opposed to the "any" combination of the previous embodiment.

Figure 8:
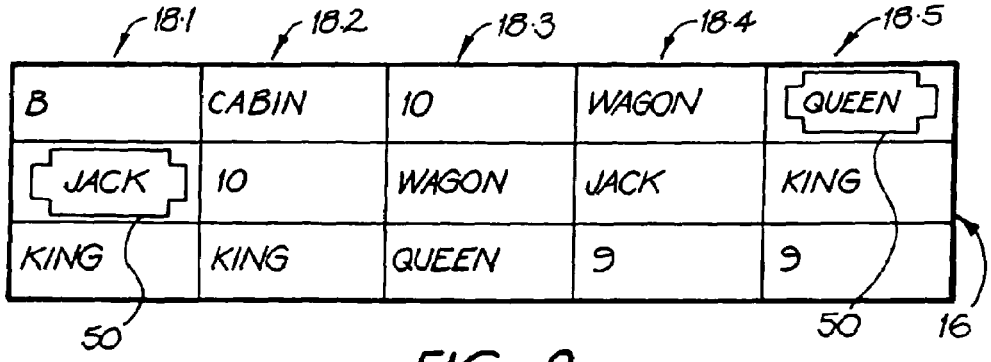
FIG. 8 shows a display screen of another embodiment of a game played on the gaming machine.
Figure 9:
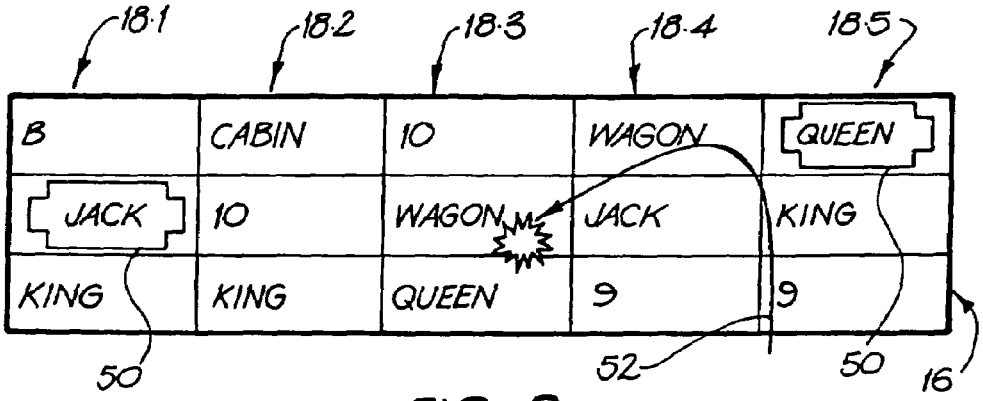
FIGS. 9 to 12 show various representations of display screens of an embodiment of a feature associated with the game of FIG. 8.
Figure 10:
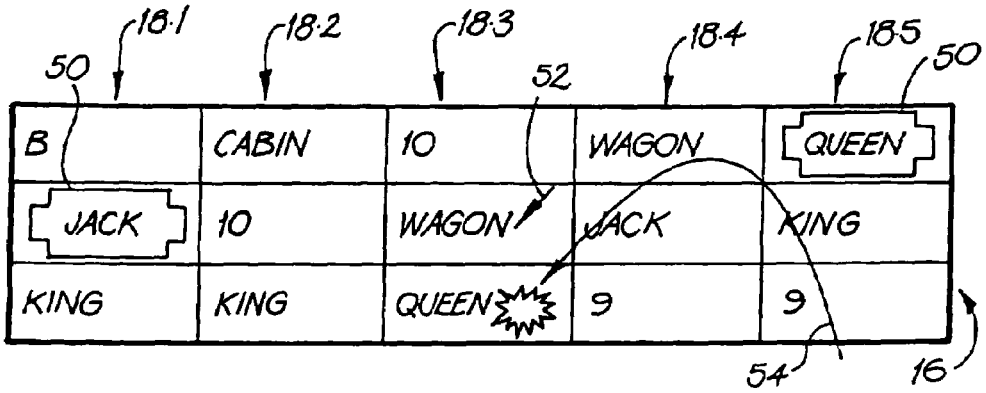
Figure 11:
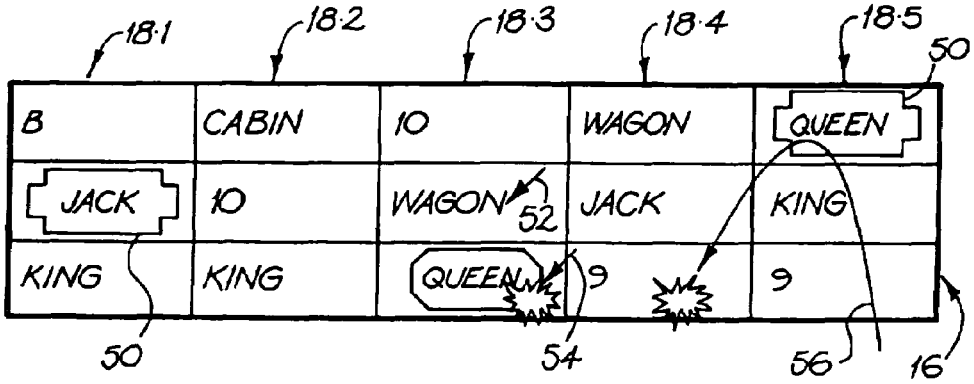
Figure 12:
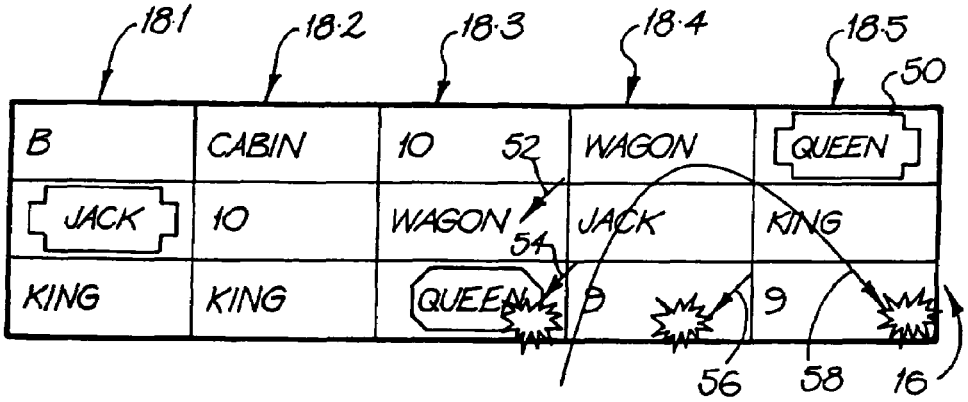

In this embodiment of the invention, the trigger condition is the presence of a background "haystack" symbol 50 spun up on reels 18.1 and 18.5 at the same time. When this occurs, as illustrated in FIG. 8 of the drawings, the feature is triggered.

In this embodiment, a message (not shown) is displayed on the screen 16 to indicate that the player should hit a "Fire" button 20.1 (FIG. 1) on the keypad 20.

The hitting of the "Fire" button initiates the feature. An animated arrow, as illustrated at 52 in FIG. 9 of the drawings, flies up from a bottom of the screen 16 over the currently displayed reels 18 and comes to rest in one of the symbols. In this case, the arrow 52 strikes the "Wagon" symbol on reel 18.3.

Assuming nine lines are being played, when the arrow 52 strikes the "Wagon" symbol in reel 18.3, the arrow 52 ignites and substitutes for the "Wagon" symbol. Accordingly, in this embodiment, a win is paid for 3×King and 3×9 on payline seven.

The feature comprises the firing of a number of arrows, for example, seven arrows. Accordingly, once the first arrow 52 has been fired, and prizes paid, as the case may be, a second arrow 54 (FIG. 10) is fired. In this case, the arrow 52 burns out and dies down. In other words, the arrow 52 remains in the "Wagon" symbol on reel 18.3 but no longer substitutes.

The arrow 54 strikes the "Queen" symbol on reel 18.3 and ignites. In this case, a win is paid for 3×King and 3×9 on the third payline.

When a following arrow 56 is "fired" it strikes the "9" symbol on reel 18.4. The arrow 54 continues burning in the "Queen" symbol on the reel 18.3 and, accordingly, the flaming arrow 54 continues to substitute. Hence, in the embodiment shown in FIG. 11 of the drawings, a win is paid for 4×King and 3×9 on the third payline.

Yet a further arrow 58 is fired at the reels 18 and strikes the "9" symbol on reel 18.5 where it substitutes. Due to the fact that both the preceding arrows 54, 56 continue burning, they also constitute substitute symbols. Accordingly, in respect of the embodiment shown in FIG. 12 of the drawings, a win is paid for 5×King on payline three, 3×Wagon on payline seven, and all three of a kind on payline three except Kings and Scatters, i.e. the three burning arrows 54, 56 and 58 substitute for all symbols except scatters.

The feature is continued until all the flaming arrows have been fired. When this occurs the message "Feature Completed" is displayed. All wins from the feature are accumulated on the win meter of the gaming machine 10.

Instead of the flaming arrows, a goose or duck could be made to "waddle" from one position to the other and to pay prizes in which it substitutes. The goose or duck may or may not lay an egg at its previous symbol position before moving to the next position. The egg then acts as an additional or residual substitute symbol to be paid in addition to wins with the bird substituting at its current position.

In yet another embodiment of the invention, relating to the applicant's "Penguin Pays" game certain triggering combinations commence a feature involving an animated skating penguin. The animations start with the penguins skating to the top left-hand symbol on the screen 16 and progressively skating to each of the fifteen symbol positions on the screen 16. At each position, all wins on which the skating penguin substitutes are paid. The embodiment of the new invention extends this feature also to include other penguins being left behind at random positions that the skating penguin visits. Every time the skating penguin moves to a new position, all wins will be paid in which the left-behind penguins substitute in addition to those wins with the skating penguins substituting.

Prizes are only paid during each step of the feature for combinations in which the substitute symbol and/or residual substitute symbol substitutes.

Hence, it is an advantage of the invention that a game is provided which will provide more entertainment for players and will result in increased payouts to the players.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine which includes:

a display means on which a plurality of display positions are displayed, the display positions being arranged in a predetermined region of the display means; and a game control means arranged to control images displayed on the display means, the control means also controlling playing of a game on the machine, the game comprising a video representation of a plurality of spinning reels, each reel comprising a set of reel symbols wherein a plurality of reel symbols are randomly selected and displayed in the display positions on the display means such that, if a winning combination results, the machine pays a prize, the control means being operable, upon the occurrence of a predetermined triggering event, to generate a series of bonus symbols in a bonus feature game comprising a plurality of rounds, said bonus symbols being substitute symbols arranged to substitute for one or more of the reel symbols;

wherein a first bonus symbol in the series is displayed in one display position and is taken into consideration in determining a first award based on at least one payline-based winning combination wherein said winning combination includes at least a first bonus symbol and reel symbols which are not bonus symbols and, thereafter, a second bonus symbol in the series is displayed in at least one other display position without changing the positions of the spinning reel symbols in a subsequent round and the control means further being operable to make a determination, when the first bonus symbol appears at the one display position, whether or not the first bonus symbol is to remain at the one display position as a residual substitute symbol and, if the determination is that the first bonus symbol is a residual substitute symbol, when the second bonus symbol appears at the at least one other display position, both the first bonus symbol and the second bonus symbol are taken into consideration in determining an award based on at least one other payline-based winning combination wherein said winning combination includes at least the first and second bonus symbols and reel symbols which are not bonus symbols; or if the determination is that the first bonus symbol is not to remain at the one display position as a residual substitute symbol when the second bonus symbol appears at the one other display position, the second bonus symbol is taken into consideration in determining an award based on at least yet another payline-based winning combination and the first bonus symbol is not taken into consideration.

2. The gaming machine of claim 1 in which the substitute symbols are triggered when a predetermined combination of symbols is displayed.

3. The gaming machine of claim 1 in which the substitute symbols are triggered when a special symbol is displayed in a particular position on the display means.

4. The gaming machine of claim 3 in which, to trigger the substitute symbols, the special symbol must appear in conjunction with at least one other special symbol, the at least one other special symbol also having to appear at particular display positions.

5. The gaming machine of claim 4 in which each of said special symbols is a background symbol arranged behind another symbol.

6. A gaming machine as claimed in claim 1 wherein a third bonus symbol appears at another display position, and wherein at least one of the first and second bonus symbols and the third bonus symbol are taken into consideration in determining an award based on at least one other winning combination.

7. A gaming machine as claimed in claim 1 wherein when each occurrence of a first or second bonus symbol is generated, animation occurs of the first or second bonus symbol originating and entering the predetermined region of the display means from a location arranged externally of the predetermined region of the display means.

8. A gaming machine as claimed in claim 1 wherein when each occurrence of a first or second bonus symbol is generated, in the event of a substitute symbol being a residual substitute symbol, said residual substitute symbol follows an animation sequence which continues for the duration that a first or second symbol acts as a residual substitute symbol.

* * * * *

UNITED STATES PATENT AND TRADEMARK OFFICE

CERTIFICATE OF CORRECTION

PATENT NO. : 7,014,559 B1
APPLICATION NO. : 10/111024
DATED : March 21, 2006
INVENTOR(S) : Colin Fong It is certified that error appears in the above-identified patent and that said Letters Patent is hereby corrected as shown below:

TITLE PAGE

Item (73), after "Lane Cove" enter -- New South Wales --

Item (57), line 2 of Abstract, after "display" delete "of display"

Item (56), page 2, column 2, line 5 of Foreign Patent Documents after "1999/43488" delete "3/2000" and enter -- 10/1999 --

Item (56), page 2, column 2, line 22 of Foreign Patent Documents after "9/1997" enter -- G07F/17/34 --

COLUMN 2

Line 50, delete ""flaring arrow"" and insert -- "flaming arrow" --

Signed and Sealed this

Twenty-sixth Day of December, 2006

JON W. DUDAS
*Director of the United States Patent and Trademark Office*